United States Patent [19]

Bühler

[11] 4,304,362

[45] Dec. 8, 1981

[54] BALL MILL

[75] Inventor: Gerhard Bühler, Rheinfelden, Fed. Rep. of Germany

[73] Assignee: Fryma Machinen AG, Rheinfelden, Switzerland

[21] Appl. No.: 20,653

[22] Filed: Mar. 15, 1979

[30] Foreign Application Priority Data

Mar. 18, 1978 [DE] Fed. Rep. of Germany ..... 2811899

[51] Int. Cl.[3] ..... B02C 15/00; B02C 17/14

[52] U.S. Cl. ..... 241/67; 241/69; 241/176; 241/180

[58] Field of Search ..... 241/67, 170, 171, 172, 241/173, 176, 179, 180, 69, 152 A

[56] References Cited

U.S. PATENT DOCUMENTS 2,059,795 11/1936 Johns ..... 241/179

3,993,254 11/1976 Bicik et al. ..... 241/67

FOREIGN PATENT DOCUMENTS 814374 9/1951 Fed. Rep. of Germany .

*Primary Examiner*—Mark Rosenbaum

[57] ABSTRACT

A ball mill having a housing formed with at least one inner conically cross-sectioned annular wall, in which a displacement body having a conically cross-sectioned annular outer surface is mounted. The housing and displacement body are relatively rotatable and their conical surfaces spaced respectively from each other to define therebetween an annular gap having a conical cross-section for receipt and grinding of solids, liquid and grinding balls, relatively.

14 Claims, 3 Drawing Figures

BALL MILL

BACKGROUND OF THE INVENTION

The present invention relates to a ball mill for the continuous very fine grinding and dispersing of solids in a liquid.

Ball mills are known having a housing, the inner face of which defines a grinding chamber in which a displacement body is mounted. The liquid and solids together with grinding balls are loaded into the grinding chamber and are rolled by the relative rotation of the displacement body and housing, the result of which is to grind the solids and mixture with the liquid. Usually the grinding chamber has the form of a cylinder and the displacement body is a cylindrical or conical rotor. Even if the gap between the surface of the housing and the rotor varies as by mounting the rotor eccentrically, the effect on the material to be ground is unsuitable for many purposes, the more so as the path of the movement of the material in the housing is relatively short.

In German patent specification DE-PS No. 814,374, there is shown a ball mill for making varnishes having an upwardly enlarged conical housing, into which there is inserted a similarly conical displacement body. The gap between housing and displacement body provides room, however, for only one layer of balls, which individually apply against both the grinding surfaces of the housing and of the displacement body simultaneously, resulting invariably in an insufficient grinding effect.

It is the object of the present invention to provide, combined with limited dimensions of the ball mill, the greatest possible variety of grinding action on the material to be ground, so as to obtain as thorough and as uniform as possible a fine grinding and dispersing of the solids in the liquid.

SUMMARY OF THE INVENTION

According to the present invention, there is provided a ball mill for the continuous fine grinding and dispersing of solids in liquid comprising a housing having at least one inner conically cross-sectioned annular wall, in which a displacement body having a conically cross-sectioned annular outer surface is mounted. The housing and displacement body are relatively rotatable and their conical surfaces spaced respectively from each other to define therebetween an annular gap having a conical cross-section for receipt and grinding of solids, liquid and grinding balls, relatively.

The inlet for the solids and liquid is preferably at the center of the apparatus and the outlet at the circumferential end thereby a path for the grinding material is not only circular, about the axis of rotation, but follows a cross-section path conforming to the conical (i.e. U-shape) of the gap between the housing walls and the surface of the displacement body.

Variations such as providing multiple, concentric and oppositely arranged grinding chambers formed in a similar manner can be made.

Full details of the present invention are set forth in the following description and are illustrated in the accompanying drawings.

DESCRIPTION OF THE INVENTION

Figure 1:
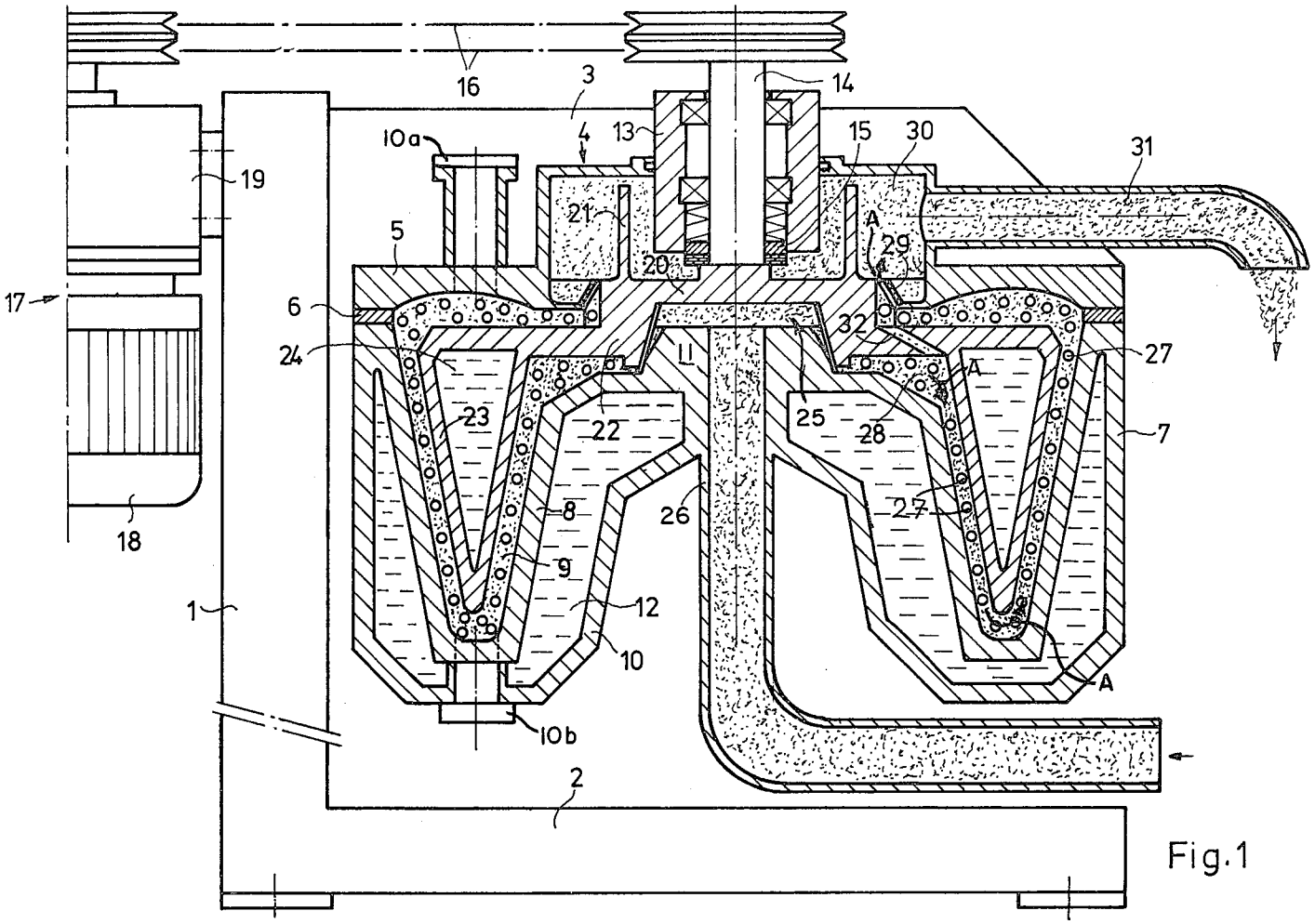
FIG. 1 is a vertical section through a ball mill embodying the principles of the present invention.

With reference to FIG. 1, the ball mill is mounted on a vertical stand or support 1 having a base 2 and a horizontal supporting arm 3 in which is formed a bearing housing 4 in which a stator cover plate 5 is suitably secured. Suspended from the stator cover 5, by means of suitable fasteners such as screws (not shown) through an exchangeable spacer ring 6 is the second portion of the stator assembly in the form of a potlike housing 7 having double walls 8 and 10. The inner wall 8 is open at the top to form a trough which with cover plate 5 forms a grinding chamber 9 in the shape of an annular ring having a conical, or triangular cross-section. The inner wall 8 and the outer wall 10 meet in a central hub 11 and define between them a heat exchanger chamber 12. Cooling or heating fluid can be introduced in known manner from suitable source and withdrawn in known manner, both through the outer wall, so as to be circulated within the chamber. The introduction and removing of grinding balls can be made through inlet 10*a* and outlet 10*b* respectively.

Sealed in the bearing housing 4 along the axis of the hub 11 is a bearing 13, which, by means of two spaced roller bearings, journals a shaft 14. Suitable packing 15 is provided to seal the bearing 13. A drive belt 16 driven by an adjustable drive unit 17, consisting for example of a three-phase a-c motor 18 and a variable transmission 19, (or of a variable d-c motor and a step-down transmission) drives the shaft 14 about the central axis. Secured to the bottom end of shaft 14 is a rotor comprising a hub 20 having a radially outwardly extending annular disk 22 from which depends, into the grinding chamber 9 a ring-shaped displacement body 23. The body 23 is conical in cross-section, having a taper similar to that of the grinding of the chamber 9, so as to maintain an approximately constant distance from the wall 8. The annular ring is hollow and forms an annular cavity 24, through which heat exchange medium can also be passed.

Moreover, the central portion 20 of the rotor is axially spaced from the hub 11 to form a small chamber 25 defining a colloid mill to which the material to be ground is fed via a feed pipe 26 which extends upwardly through the hub 11. The surfaces forming the colloid mill may be provided with "teeth" or other abrasive means to grind the material.

The grinding chamber 9 is filled with balls 27 to about 60% to 90% of its volume. The upper end of the interior portion of the wall 8 is widened so as to communicate with the colloid mill space 25 to form an inlet region 28 maintains approximately constant clearance with a constantly increasing diameter. The material to be ground flows through the chamber 9, in a U-shaped path up from the inlet region 28 following arrow A to a separating device 29 such as a screen, where it enters a space 30 enclosed by the upper surface of the rotor and the bearing housing 4 and then passes into an outlet line 31. An axially extending annular flange 21, integral with the rotor extending into the space 30 and acts as an agitator for the material and liquid.

The balls 27 which are selected so as to be freely moveable in the grinding chamber 9 with simultaneous contact with walls 8 and 23 also follow the same path A, but are rejected by the separating device 29 and then pass into one of several return channels 32, arranged in the annular disk 22 of the rotor in a direction obliquely outward. The return channels communicate with the inlet region 28 but are arranged so that the centrifugal forces acting on the balls at this point are greater than the feed pressure from the colloid mill space 25 acting from the entrance region 28, so that the balls return to the grinding chamber 9.

The grinding gap (i.e. the space between wall 8 and 23) can be varied continuously by moving the grinding housing 7 either axially, radially or eccentrically relative to the rotor cover 5. In principle, the reverse arrangement, of moving the displacement body 23 relative to the grinding housing, is possible also.

Likewise, the functions of the rotor and stator may be interchanged; that is, the displacement body may be fixed as a component part of the stator and the part of the stator forming the grinding housing 7 may be journalled about and revolved about the hub inlet shaft 26.

If complete circulation of the grinding balls is not desired, the balls can be separated from each other within the grinding gap by sieves (i.e. screens) or the like extending across the path of the gap thus dividing the gap into more than one section, so that balls of varying diameter (e.g. in zones decreasing from a first to a last in refinement grinding) can be provided so that the degree of crushing being thus sequentially more and more refined.

The grinding balls execute primarily a rolling movement on the conical surfaces of the housing and displacement body defining the grinding gap as well as a revolving movement about the central axis superposed on it an axial feed movement. It may be desirable especially for highly viscous products to provide the surfaces defining the grinding gap with a certain degree of roughness, e.g. with cast-in ribs, grooves, or pins or also entrainment elevations, so that regardless of the nature of the material to be ground a positive entrainment of the grinding bodies is achieved.

Figure 2:
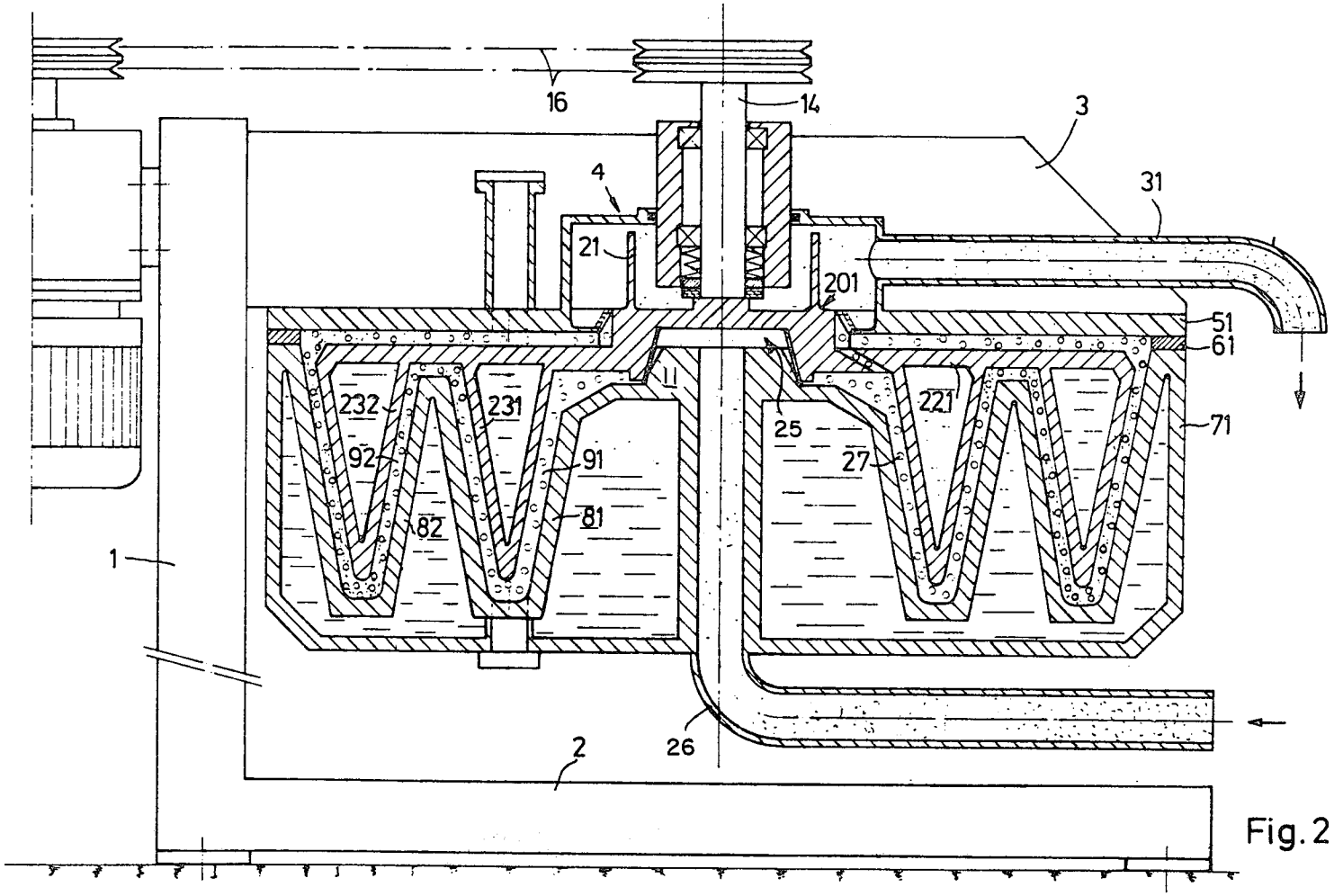
FIG. 2 is a view similar to FIG. 1 showing another form of a ball mill according to the present invention.

In the ball mill shown in FIG. 2, wherein like numbers represent like parts to those of FIG. 1, two cone-shaped grinding gaps 91, 92 if approximately equal cross-sectional design are arranged concentrically one in the other. The gaps are defined by two-double-cone-shaped displacement bodies 231 and 232. The two displacement bodies are mounted on a common annular flange portion of the rotor 201, which similarly forms as in FIG. 1 with the housing a colloid mill 25. Here again the gap variation occurs by exchanging the elastic spacer ring 61 between the cover plate 51 and the grinding housing 71.

The material to be ground is supplied under pressure through the feed pipe 26 and passes, after leaving the colloid mill 25, successively through the grinding gaps 91 and 92. Since the diameter of the housing enlarges with the continuous flow from the central inlet to the outlet, the effective grinding speed, i.e. the velocity of action of the balls on the material on the one hand increases, while on the other hand the gap path is increased constantly at substantially constant gap width, thereby reducing the flow velocity. Both have the effect of a continuous intensification of the grinding process up to the outer diameter. In all other respects, the apparatus of FIG. 2 is constructed and functions as the apparatus of FIG. 1.

Figure 3:
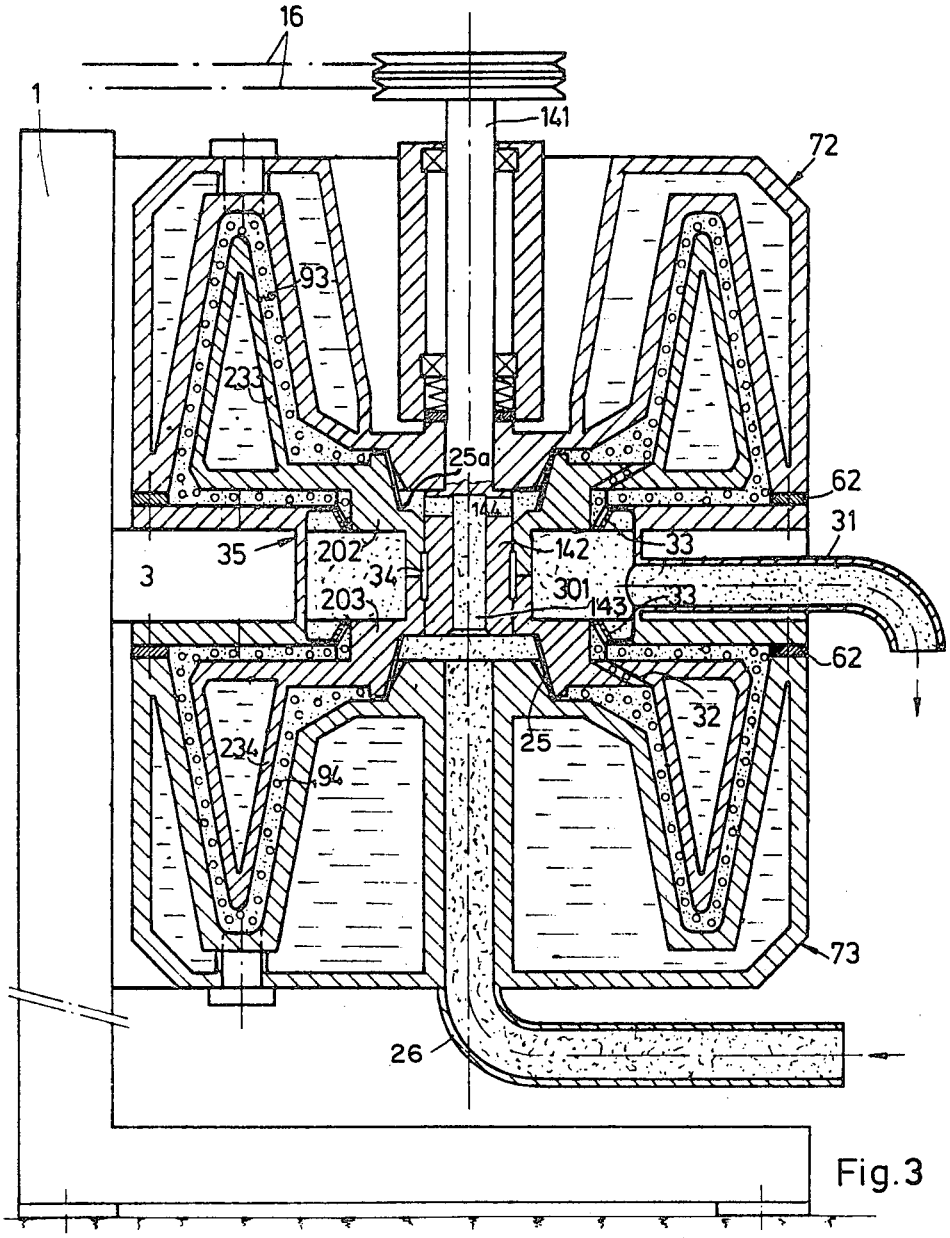
FIG. 3 is a view similar to FIG. 1 showing still another form of construction of a ball mill according to the present invention.

In FIG. 3, a mill as shown in which the arrangement of FIG. 1 is symmetrically doubled on itself along a central horizontal plane. In this embodiment, the horizontal support 3 is located midway along the vertical support 1. The stator housing cover 35 is fixed on both the upper and lower surfaces of the support 3 and is symmetrical to the horizontal plane. The drive belt 16 is connected to a shaft 141 which extends through the upper mill section, terminating in a head 142 which fits with a central bore in the stator cover 35. The head 142 has an axial bore 143 open toward the free or lower shaft end and a radial cross bore 144 at the upper head end. On the shaft head 142 there are fastened, by means of keys such as cotters 34, two identical rotors 202, 203 arranged in mirror symmetry. The rotors 202 and 203 each have displacement bodies 233 and 234 extending upwardly and downwardly, respectively, extending into grinding chamber 93 and 94 which are formed, respectively, in two grinding housings 72 and 73, each shaped as in FIG. 1. An elastic spacer 62, which is interchangeable to vary the distance between rotor and stator plate is provided.

A feed line 26 opens into the inlet space of the lower colloid mill 25 formed between the hub 11 and the free end of head 142 and communicates by the bores 143 and 144 with the inlet space of the upper colloid mill **25*a*. Above and below a horizontal plane of symmetry perpendicular to the axis of rotation and passing through the center of the support arm 3, there is formed a mill arrangement exactly as shown in FIG. 1. Return channels 32** for the grinding balls are provided.

A common outlet pipe 31 communicates with a chamber 301 which is formed between the two rotors 202 and 203 annularly with the intermediate stator housing 35. The outlet communicates with outlet connections 33 from each of grinding chambers 93 and 94. The two grinding chamber therefore, are connected in parallel. However, it is readily possible also here to provide a series connection, for instance by closing bore 143 at the bottom and letting it communicate with the outlet connection 33 of the grinding chamber 94.

Also there may be provided at this point (bore 143) a switching valve or the like which selectively permits the operation of the mill in parallel or series connection. Also, the designs of FIGS. 2 and 3 may be combined in such a way that on both sides of the horizontal plane of symmetry several concentric grinding chambers or gaps may be provided, which are connected in parallel or in series as needed.

The ball mills according to the invention may be arranged in almost any desired manner, that is, with vertical, horizontal, or inclined axis, and may be provided with known feed devices.

The displacement bodies need not be physically separate, but may be formed by correspondingly designed projections of the rotor flange or may be a component part of the stator.

By constructing the inner face of the grinding housing and the surface of the displacement body as similar annular cones, i.e. as bodies with at least triangular or wedgeshaped cross-section, the material to be ground sweeps the gap optimally along two wedge faces from the inside out and also on the back wall. The material undergoes first a uniform low impact and grinding effect (along the inner wall face of small diameter), whereby the coarse particles are crushed, and this grinding motion is increased continuously along the wall of larger diameter. Due to the larger gap volume, the number of balls per volume of material to be ground increases, and hence also the number of solid particles. By enabling axial displacement of the rotor relative to the stator, the actual grinding gap can be regulated continuously, so that taking into account the viscosity, throughput and grinding ball dimension, an optimum grinding effect can be obtained. The grinding gap can always be made larger than the ball diameter, so that a ball never makes contact simultaneously on the grinding housing or on the displacement body. Therefore, small grinding and relief zones will alternate continuously, with the result that the balls are continuously being rolled around in the grinding chamber. Thereby the treatment of the material is made uniform and its refinement intensified.

If the grinding chamber or gap is divided by divisional elements into various grinding zones and provided with balls of different thickness and/or various grinding gap widths, this can contribute to a further graduation and gradual refinement of the grinding effect in the same mill.

The entire grinding chamber may also be subdivided by separating elements into different grinding zones with balls of different size and with or without differing gap widths. It is thus possible to connect quite different grinding passes one behind the other in the same mill. The surfaces defining the grinding chamber may be provided with wrinkles or, respectively, with elevations or depressions such as ribs, grooves or pins and the like. Advantageously, the walls may be made of wear-resistant material such as hard metal (such as cemented carbide, hard manganese, etc.)

It is possible according to the invention to arrange a ball return between the outlet and inlet regions. This is facilitated when the return channels extending obliquely outward and are provided in the annular flange forming the rotor. As a result, centrifugal forces then cause the return of the balls, with sufficient force to overcome the counteracting force of the feed pressure of the suspension of material to be ground.

As the displacement body has a larger diameter and hence can keep the region adjacent of the mill shaft free to a large extent, the ball mill can be provided in a simple manner on the inlet side with a grinding device formed by the rotor and stator port, such that a "tooth" colloid mill is additionally formed. This does not even require any special structural parts since cooperating surfaces of rotor and stator parts do exist and can be easily provided with the toothings, corrugations, etc. This colloid mill provides a suitable pretreatment and grinding of the solids.

At least one wall defining the grinding casing can be made contiguous the means for supplying by heat exchanger medium so that in principle, the walls of the rotor and of the stator can be cooled. As a result, all parts coming in contact with the material to be ground and with the balls can be optimally cooled, thus, controlling the heat generated within the apparatus by the grining action itself. Compared with the known designs, the ratio between effective grinding volume and heat exchange surface is increased by a multiple.

An advantage of the apparatus shown in FIG. 2 lies in the fact that several double-cone grinding chambers are provided into which displacement bodies mounted on a common shaft can be used. These displacement bodies may rotate at different or equal speeds by the provision of suitable converting transmissions. Preferably, however, they are rigidly connected together or are formed by a common component. The two grinding chambers swept mainly from the inside out, can be connected in series. In the grinding chambers, the material to be ground always has—disregarding the return path for the moment—a radial flow component. As the width of the grinding gap remains approximately the same, the passage area increases continuously, while the speed of rotation of the ball increases approximately in the same ratio, so that the intensity of the grinding process increases continuously.

According to the proposal of FIG. 3, the two grinding housings provided opposite to each other in a tandem arrangement permit inflow and outflow to be arranged either at a central housing or in the axis of rotation.

At variance with the usual design of a fixed grinding housing, the latter may be driven rotatably about the mill shaft, that is, take over the function of the, or of a, rotor. The grinding housing and displacement body may rotate in opposite direction of rotation.

Various embodiments, modifications and changes to the basic concept of the present invention are suggested herein. Other such changes and modifications will be obvious to those skilled in this art. Accordingly, the present disclosure is intended to be taken as illustrative only of the present invention and not limiting of it.

What is claimed:

1. A ball mill for the continuous fine grinding and dispersing of solids in liquid comprising a housing having a central axis and at least one conical inner wall defining a ring shaped chamber radially spaced from said central axis and having a conical cross section, an annular displacement body having a conical cross-sectioned outer surface conforming to said chamber, means for mounting said displacement body within said housing with the conical surface spaced from the conical wall of said ring shaped chamber, to define therebetween an annular gap having in cross-section a pair of angularly disposed connected arms for the passage of solids, liquid and grinding balls, means for rotating said displacement body relative to said housing about the central axis to effect the grinding of said solids by said balls within said gap, an inlet to the radially inner one of the arms of said gap for the introduction of solids and liquid, and an outlet from the radially outer one of the arms of said gap for the discharge of ground solids and liquid, and duct means extending through said displacement body between said outlet and said inlet obliquely to the central axis for return circulation of the grinding balls to said gap.

2. The mill, according to claim 1, including a supporting frame having a housing cover mounted above said displacement body and forming therewith a passage communicating with the outer one of the arms of said gap and extending angularly to each of the arms of said gap, means for securing said housing to said cover, a shaft extending through said cover along the central axis of said housing, a rotor member secured to said shaft, said displacement body being secured to said rotor, said means for rotating said displacement body comprising a drive motor connected to said shaft.

3. The mill, according to claim 2 wherein said frame includes a horizontal bearing arm and said housing cover is fixedly mounted to said bearing arm.

4. The mill, according to claim 2, including feed means located coaxially with said shaft in communication with the inlet to said radially inner arm of said gap and discharge means located in said housing cover in communication with the passage communicating with the radially outer one of the arms of said gap.

5. The mill, according to claim 4, including a screen located between said discharge means and said passage to prevent movement of grinding balls therethrough.

6. The mill, according to claim 5, wherein said housing has a central hub axially aligned with the rotor fixed to said shaft, said central hub and said rotor being axially spaced from each other, said feed means and inlet connecting with said space whereby the solid material may be pre-ground therein.

7. The mill, according to claim 6, wherein the surface of said rotor and said hub are provided with means for forming therebetween a colloid mill.

8. The mill, according to claim 1, including means for adjustably mounting said displacement body and said housing relative to each other to selectively vary the gap defined therebetween.

9. The mill, according to claim 1, including separating means for dividing the gap defined by said displacement body and said housing into different zones.

10. The mill, according to claim 9, including means for varying selected portions of the width of the space defined between the surface of the displacement body and the wall of said housing.

11. The mill, according to claim 1, wherein said housing is formed of a double wall defining between the inner and the outer wall a hollow passage for heat exchange media.

12. The mill, according to claim 1, wherein said displacement body is hollow for receipt of heat exchange media.

13. The ball mill, according to any one of claims 2 through 12, wherein said housing is formed with a plurality of conically cross-section ring shaped chambers, concentric with each other, and said displacement body is conformingly formed with a corresponding number of conically cross-sectioned outer surfaces, thereby forming therebetween a plurality of annular gaps.

14. The ball mill, according to claim 13, including connecting means between the adjacent arms of said annular gaps, whereby said gaps are arranged in series said inlet communicating with one arm of the inner most annular gap and the outlet communicating with the other arm of the outermost annular gap.

* * * * *